US011616300B1

(12) United States Patent
Bastin

(10) Patent No.: US 11,616,300 B1
(45) Date of Patent: Mar. 28, 2023

(54) MINIATURE BROADBAND ANTENNA ASSEMBLY

(71) Applicant: Nantenna LLC, Melbourne, FL (US)

(72) Inventor: Gary L. Bastin, Palm Bay, FL (US)

(73) Assignee: Nantenna LLC, Melbourne, FL (US)

( * ) Notice: Subject to any disclaimer, the term of this patent is extended or adjusted under 35 U.S.C. 154(b) by 0 days.

(21) Appl. No.: 17/671,915

(22) Filed: Feb. 15, 2022

(51) Int. Cl.

| | |
|---|---|
| ***H01Q 5/22*** | (2015.01) |
| ***H01Q 1/52*** | (2006.01) |
| ***H01Q 1/48*** | (2006.01) |
| *H01Q 5/357* | (2015.01) |

(52) U.S. Cl.
CPC ..... *H01Q 5/22* (2015.01); *H01Q 1/48* (2013.01); *H01Q 1/523* (2013.01); *H01Q 5/357* (2015.01)

(58) Field of Classification Search
CPC .. H01Q 1/48; H01Q 1/521–523; H01Q 15/00; H01Q 15/008; H01Q 15/14; H01Q 5/20–22
See application file for complete search history.

(56) References Cited

U.S. PATENT DOCUMENTS

| | | | | |
|---|---|---|---|---|
| 3,990,024 | A | 11/1976 | Hou | |
| 6,181,281 | B1 | 1/2001 | Desclos et al. | |
| 7,042,403 | B2 | 5/2006 | Colburn et al. | |
| 7,183,978 | B1 | 2/2007 | Azar | |
| 7,253,770 | B2 | 8/2007 | Yegin et al. | |
| 7,855,689 | B2 * | 12/2010 | Fukui | H01Q 21/068 343/846 |
| 8,228,251 | B1 | 7/2012 | Behdad et al. | |
| 8,773,312 | B1 | 7/2014 | Diaz | |
| 9,590,314 | B2 * | 3/2017 | Celik | H01Q 1/38 |

(Continued)

FOREIGN PATENT DOCUMENTS

| | | | |
|---|---|---|---|
| EP | 3633789 | A1 | 4/2020 |
| WO | 2004066441 | A1 | 8/2004 |
| WO | 2016144155 | A1 | 9/2016 |

OTHER PUBLICATIONS

Altunyurt, Nevin et al., "Antenna Miniaturization Using Magneto-Dielectric Substrates", IEEE 2009 Electronic Components and Technology Conference, pp. 801-808.

(Continued)

*Primary Examiner* — Hasan Islam
(74) *Attorney, Agent, or Firm* — Howard & Howard Attorneys PLLC

(57) ABSTRACT

The teachings of the present application generally provide a solution to one or more of the aforementioned needs by providing for a ultra-high frequency (UHF) antenna assembly which provides for a smaller package size with the same or better efficiency as a much larger antenna, particularly at 100 MHz to 500 MHz. Particularly, through the combination of components and structures for implementing frequency selective surfaces (FSS) and high impedance structures (HIS) in combination with an anisotropic magneto-dielectric material, the present teachings provide for the use of both lower and higher frequency techniques at 200 MHz to 400 MHz frequency range and miniaturization, accurately improving the performance of UHF satellite communication antennas. Specifically improving performance in narrow-band, with increases in efficiency, bandwidth, and lowered elevation angle radiation characteristics.

18 Claims, 7 Drawing Sheets

(56) References Cited

U.S. PATENT DOCUMENTS

| | | | | |
|---|---|---|---|---|
| 9,596,755 | B2 | 3/2017 | Sethumadhavan et al. | |
| 9,692,132 | B2 * | 6/2017 | Kawaguchi | H01Q 1/32 |
| 10,014,572 | B2 * | 7/2018 | Tagi | H01Q 1/525 |
| 10,862,198 | B2 | 12/2020 | Guthrie et al. | |
| 10,938,120 | B2 | 3/2021 | Rogers et al. | |
| 2012/0162021 | A1 | 6/2012 | Lee et al. | |
| 2020/0099122 | A1 | 3/2020 | Rogers et al. | |

OTHER PUBLICATIONS

Bastin, Gary L., "Photonic Bandgap (PBG) Shielding Technology", Space and Missile Defense Conference, Huntsville, AL, Aug. 13-16, 2007, 2 pages.

English language abstract for WO 2004/066441 A1 extracted from espacenet.com database on Jan. 27, 2022, 2 pages.

Ermutlu, M.E. et al., "Patch Antennas With New Artificial Magnetic Layers", Apr. 2005, 8 pages.

* cited by examiner

MINIATURE BROADBAND ANTENNA ASSEMBLY

REFERENCE TO GOVERNMENT RIGHTS

This invention was made with United States government support under Contract number FA864921P0560 awarded by the United States Air Force. The United States government has certain rights in the invention.

TECHNICAL FIELD

The general teachings of the present application relate to systems and methods relating to the miniaturization of ultrahigh frequency antennas.

BACKGROUND

In the field of mobile communication, particularly satellite communications, various types of low-profile patch antennas have been extensively used because of their advantage of compactness, which are equipped with a plate-shaped dielectric substrate and a conductor patch formed on the surface of the substrate.

Varied types of small antennas, low profile antennas or microstrip antennas have been developed to address critical requirements such as improved circular polarization, improved low angle radiation pattern, widen beams, enhanced gain at low angle, dual band operation etc. Such antennas have been developed by using slotted radiating patch, high dielectric material substrate, artificial magnetic conductor, electromagnetic bandgap structure, metamaterial, and magnetodielectric materials etc.

Typically, in circularly polarized antennas, the structure of a patch antenna is frequently used. A patch antenna having a half wavelength size has a narrow beam width of about 70 degrees. To increase the bandwidth of the patch antenna, the size of the patch is reduced so as to be still smaller than the half wavelength using a high-k substrate, or a ground plane having a three-dimensional structure such as a pyramid is used. However, when the size of the patch is reduced, the return loss bandwidth of the antenna is reduced. When the ground plane having a three-dimensional structure is used, the thickness of the antenna is increased.

Miniature antennas have number of merits in terms of size, efficiency, compatibility, etc. relatively small antennas have trade-offs such as efficiency sensitive to magnetic loss and bandwidth narrower than other cases. However, the need for a miniaturized antenna with improved bandwidth, gain, efficiency, or a combination thereof still exists.

Accordingly, there remains a need to have an expansion of usable frequency bandwidths of miniaturized antennas without increasing sizes of radiating element(s). There is a need for allowing the use of both lower and higher frequency techniques at 220 MHz to 380 MHz frequency range where such techniques have previously been impossible.

As mentioned above, a target frequency of sending and/or receiving radio waves below 500 MHz with a miniaturized antenna may be desired. To either generate or to receive such a wave and simultaneously achieve sufficiently wide bandwidths, a physical structure electrically that is large enough, comparable to a wavelength, is required. The wavelength, k, in meters, existing in free space for any given electromagnetic radiating and propagating wave at any given frequency is given by:

$$\lambda_{meters} = \frac{300}{f_{MHz}}$$

The physical structure may be smaller than the physical dimensions of the propagating wave while traveling in free space. A common antenna structure that meets these requirements is a half wave dipole. In the case of a half-wave dipole, the dimension is approximately 95% of the half wavelength as measured in free space. The reason for this being different than half of the propagating wavelength is that a capacitive end-effect, occurring at the tips of the half-wave dipole, imparts an electrical lengthening of the antenna's electrical length, making the antenna electrically longer than its physical length. Hence, to tune such an antenna to resonance, shortening the antenna to approximately 95% of the true half-wavelength as measured in free space becomes necessary. The electrical length of the antenna approaches the true half wavelength relative to the electrical length, and the antenna becomes resonant, able to transmit and receive electromagnetic energy efficiently.

The physical length for such an antenna, as a function of wavelength, becomes:

$$l = x/\lambda \text{ and } x \cong \frac{0.95}{2}$$

This is the approximate physical length or size of a common resonant antenna in free space. Such an antennas provides moderate bandwidth and exhibits high efficiency. However, such an antenna may be too large physically for many applications. By miniaturizing such an antenna, while still maintaining both efficiency and bandwidth, and extending the bandwidth of the antenna relative to the simple half-wave dipole antenna structure is desired.

SUMMARY

The teachings of the present application generally provide a solution to one or more of the aforementioned needs by providing for an ultra-high frequency (UHF) antenna assembly which provides for a smaller package size with the same or better efficiency as a much larger antenna, particularly at 100 MHz to 500 MHz. Particularly, through the combination of components and structures for implementing frequency selective surfaces (FSS) and high impedance structures (HIS) in combination with an anisotropic magneto-dielectric material, the present teachings provide for the use of both lower and higher frequency techniques at 200 MHz to 400 MHz frequency range and miniaturization, accurately improving the performance of UHF satellite communication antennas. Specifically improving performance in narrowband, with increases in efficiency, bandwidth, and lowered elevation angle radiation characteristics.

The present teachings provide for an antenna assembly comprising a base, a substrate layer disposed above the base, the substrate layer having a magneto-dielectric material, and a composite layer. The composite layer including one or more radiating elements on a top surface, a ground plane forming the bottom surface and defining a plurality of bandgaps, and a dielectric material between the one or more radiating elements and the ground plane. The plurality of bandgaps defined by the ground plane include a first bandgap and a plurality of second bandgaps, wherein the first bandgap prevents circulating ground currents at a first frequency range, and the plurality of second bandgaps prevents circulating ground currents at a second frequency range.

The teachings further provide for a miniature antenna assembly with an operational frequency between 100 MHz and 500 Mhz. The antenna assembly comprising a base, a substrate layer disposed on the base, the substrate layer having an anisotropic magneto-dielectric material, and a composite layer spaced above and apart from the substrate layer. The composite layer including two radiating elements on a top surface of the composite layer, a ground plane forming a bottom surface of composite layer, the ground plane defining a plurality of bandgaps, a dielectric material between the one or more radiating elements and the ground plane. The anisotropic magneto-dielectric substrate is configured to electromagnetically decouple the two radiating elements with respect to each other.

BRIEF DESCRIPTION OF THE DRAWINGS

Advantages of the present disclosure will be readily appreciated as the same becomes better understood by reference to the following detailed description when considered in connection with the accompanying drawings.

DETAILED DESCRIPTION

Figure 1:
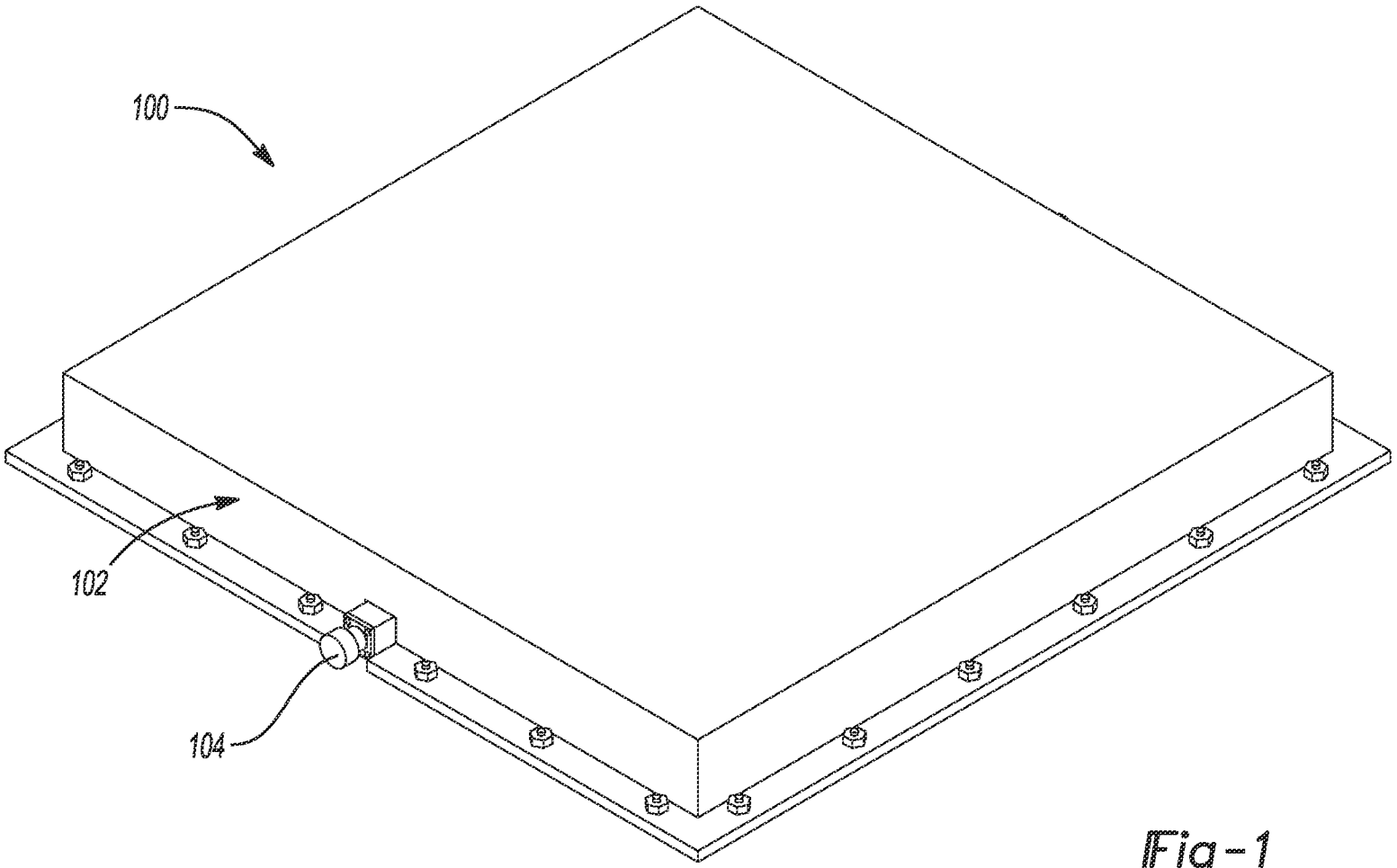
FIG. 1 is a perspective view of a broadband antenna assembly.

The present teachings pertain to an antenna assembly 100 which is physically smaller while providing the same or greater performance over a wide frequency range. The antenna is "miniaturized" by utilizing selective materials and arrangements which provide for miniaturization and broadband capabilities. The antenna assembly 100 is arranged as an antenna stack 106 including a base layer 108, a substrate layer 110 comprising an anisotropic magneto-dielectric material, and a composite layer 112 including a ground plane 114 and one or more radiating elements 116. The antenna assembly may be configured for satellite communications in the ultra-high frequency (UHF) range. It is contemplated the present teachings may be applied to different frequencies and ranges. In some examples, the antenna assembly operates at a range of 100 MHz to 500 MHz.

The present teachings generally provide for miniaturizing the size of an antenna using techniques that utilize the presence of the effects of magneto-dielectric materials having permittivity value and permeability value that are larger than the permittivity value and permeability value of free space. By incorporating selective materials, such as magneto-dielectric material, the size of the antenna assembly 100 shrinks in physical length and/or size. The magneto-dielectric material may be placed everywhere around such the antenna stack 106 (e.g., by potting the antenna stack 106 physically with the material), or placing a sheet of printed wiring material made of the magneto-dielectric material in the near-field of the radiating elements 116 of the antenna assembly 100, providing a shrinking effect on the size of the antenna assembly 100 to a set of dimensions meeting the degree of miniaturization that is desired.

The degree of miniaturization of a given antenna assembly 100 is increased by placing a volume of a magneto-dielectric material in the near-field of the composite layer 112 of the antenna stack 106 for miniaturization. The magneto-dielectric material, comprising one or more portions of the substrate layer 110 with the base 108 of the antenna stack 106 may extend beyond the dimensions of the composite layer 112, referred to as the laminate layer, to prevent wrap-around of fringing electromagnetic fields from occurring through space around the composite layer 112 of the antenna stack 106 in which there is no magneto-dielectric material. In some examples, extending the planar magneto-dielectric material of the substrate layer 110 beyond the planar extent of the composite layer 112 by about 20 percent to 40 percent larger than the planar area occupied by the composite layer 112 is sufficient to achieve miniaturizing the antenna assembly 100. In some examples, the distance of the magneto-dielectric material relative to the radiating elements 116 of the antenna stack 106 may have the same performance and miniaturization characteristics as long as the magneto-dielectric material is within the near field of the radiating elements 116. In some examples, the radiating elements 116 are enveloped in the magneto-dielectric material, encapsulating a portion or the entire antenna assembly 100, also known as "potting" the radiating elements, providing the same miniaturizing effect as placing magneto-dielectric material within the near-field of the radiating elements 116.

The determination of the appropriate amount of magneto-dielectric material may be accomplished by placing varying thicknesses of magneto-dielectric materials in the near field of antenna structure and observing when the degree of antenna miniaturization has no further miniaturization effect when the thicknesses and expanses of magneto-dielectric material is increased.

Such use of magneto-dielectric material allows the use of a minimal amount of the magneto-dielectric material necessary for accomplishing antenna miniaturization, and allows the use of standard antenna manufacturing techniques, with the magneto-dielectric material being a sheet of material with appropriate properties.

The physical miniaturization, or shrinking, of an antenna assembly 100 is dependent on the electrical length of the antenna. The electrical length of such a dimension or length of an antenna, is dependent on the actual physical length, l, of the antenna structure multiplied by the effective propagation constant of the media, β, in which this physical dimension or length device is placed, whether being completely enveloped in a single medium, or when placed in close proximity to such a medium, or when placed in proximity to multiple media of which all have or exhibit appropriate magnetic and electrical properties. In the present example, an anisotropic magneto dielectric material is used in the substrate layer 110, which is described further below.

The propagation constant acts like a scaling factor, increasing the electrical dimensions of the antenna assembly 100, thereby reducing the resonant frequency of the antenna. To maintain operational capability at a given frequency, the physical size of the antenna assembly 100 therefore has to be reduced by an equivalent inverse multiplicative factor. This effect enables physical miniaturization of the antenna. The derivation of the physical size reduction equation follows.

The propagation constant beta, $\beta$, is dependent on the wavelength, $\lambda$, as well as the permittivity, $\varepsilon$, and the permeability, $\mu$. The permittivity, $\varepsilon$, is given by the product of the permittivity of free space multiplied by the relative permittivity of the medium in which the antenna is placed. The permeability, $\mu$, is given by the product of the permeability of free space multiplied by the relative permeability of the medium in which the antenna placed. The relative permittivity and relative permeability of the magneto-dielectric material are therefore what determine the degree of miniaturization that can be achieved.

Hence, to achieve a given fixed electrical length, which is what matters when tuning an antenna to resonance, thereby enabling an antenna to radiate and receive electromagnetic energy efficiently, when such an antenna is placed in close proximity to or is enveloped in or is placed in close proximity near a magneto-dielectric material having both high relative permittivity and high permeability, the physical length must be reduced in size by one over the product of the square root of the relativity permittivity multiplied by the square root of relative permeability, to maintain the same resonant electrical length dimensions.

Specifically, the miniaturized antenna size becomes reduced by:

$$l_{miniatureized\ antenna} = \frac{l}{\sqrt{\epsilon_r \mu_r}}$$

to maintain the same electrical length of the miniaturized antenna, for $$Length_{Electrical} = \beta * l_{miniaturized\ antenna} = \beta * \frac{l}{\sqrt{\epsilon_r \mu_r}}$$

to still tune the miniaturized antenna to resonance. Hence, the use of magneto-dielectric materials enables shrinking the physical sizes of resonant physical structures capable of radiating and receiving an electromagnetic signal efficiently. In contrast, a typical miniature satellite communications antenna, occupying the same planar area as the current teachings provide but without a magneto-dielectric substrate layer being employed, does not allow for more than one resonance of approximately 12 MHz in width over the entire 100-500 MHz bandwidth, which may be sufficient to "close" a satellite link, but is such a narrowband antenna precluding the use of all available channels in such a satellite communication link.

The present teachings provide for the usage of the majority of the possible channels provided by a broadband satellite communications system between 100-500 MHz bandwidth, increasing total data throughput and likewise increasing the total number of simultaneous users that can exploit such a satellite communications system. In some examples, the antenna assembly 100 may have an operating range 100-500 MHz. In other examples, the antenna assembly 100 may have an operating range 200-400 MHz. The present teachings provide significant performance enhancements over prior miniature satellite communications (SATCOM) antennas.

Turning to FIG. 1, illustrates a perspective view of a low-profile antenna assembly 100. The antenna assembly 100 includes a radome 102 which covers the antenna stack 106 without affecting performance of the antenna during operation. The radome 102 is constructed of materials that are free of deleterious permittivity losses, permeability losses, and hygroscopic water-holding absorptive loss properties, ensuring that the radome does not interfere with the electrical properties of the antenna stack. Input feed connectors 104 are disposed through the radome 102 into the antenna stack 106.

Figure 2:
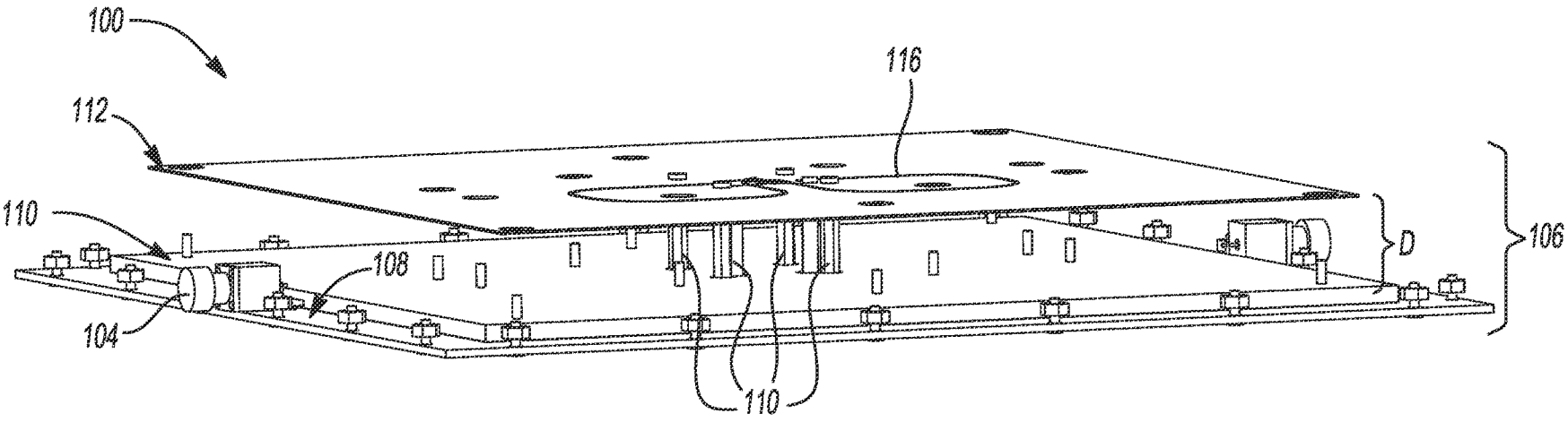
FIG. 2 is a perspective view of the antenna assembly.
Figure 3:
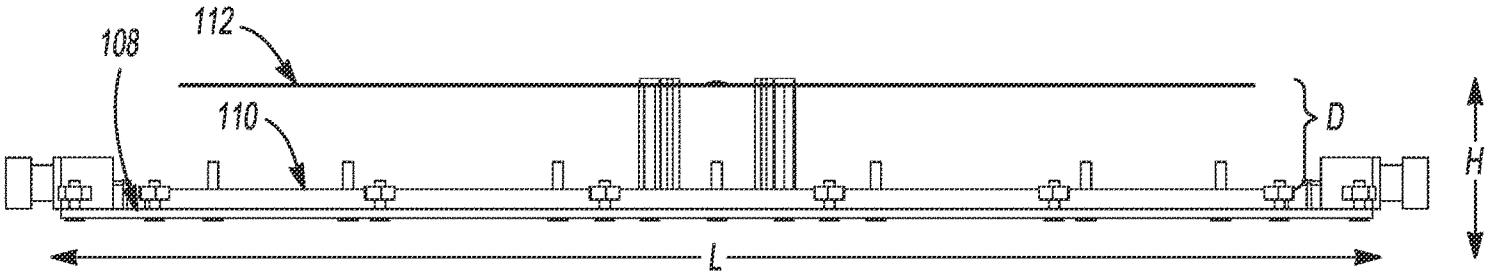
FIG. 3 is a side view of the antenna assembly.

Turning to FIGS. 2 and 3, a schematic arrangement of the antenna assembly 100 is shown. The top portion is the composite layer 112, which rests on posts 118, spacing the composite layer 112 apart from the substrate layer 110. The substrate layer 110 is disposed on top of and in communication with the base layer 108.

Figure 4:
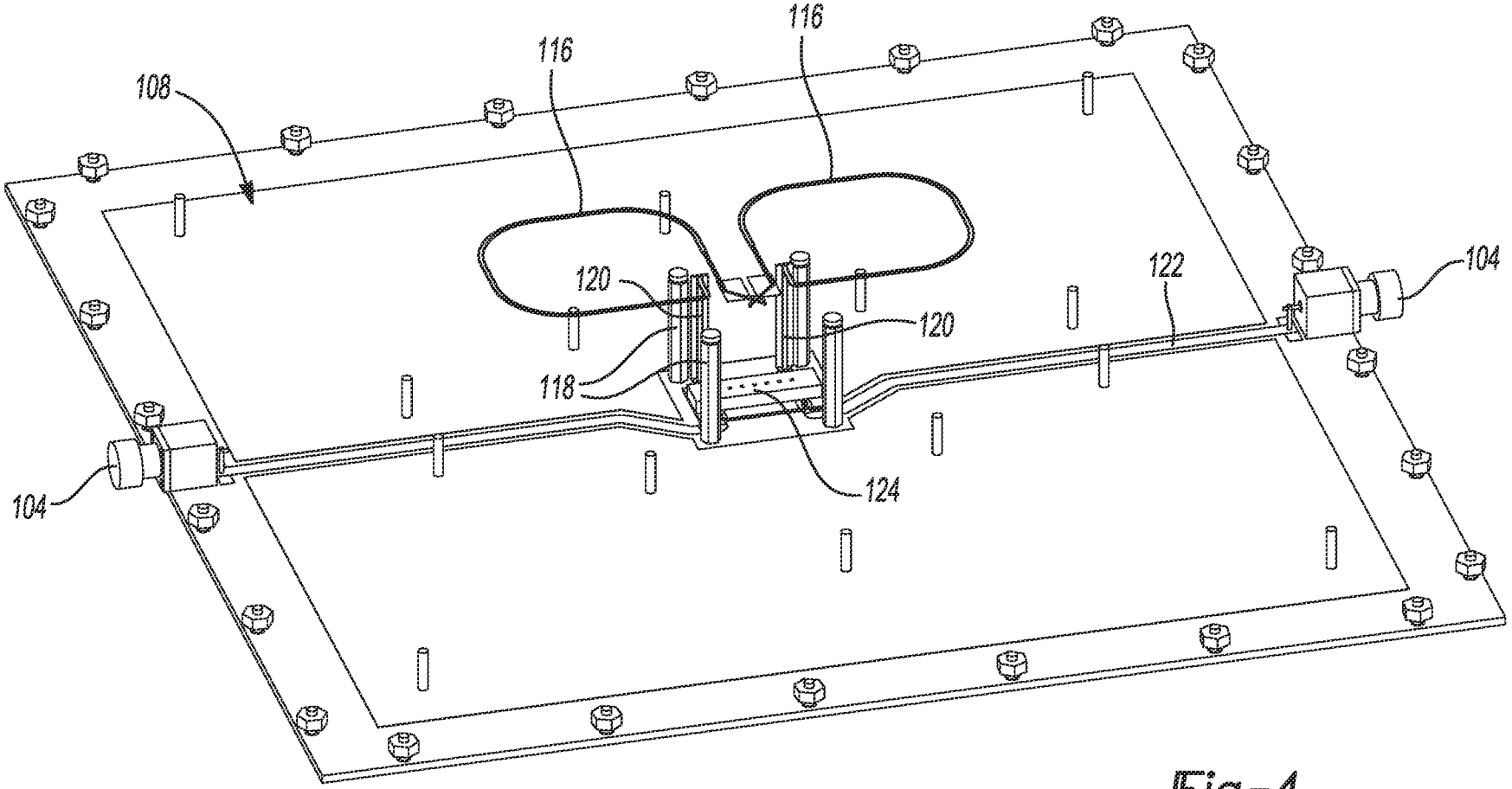
FIG. 4 is a schematic view of the base layer of the antenna assembly.

As seen in FIG. 4, the base layer 108 of the antenna assembly 100 is a printed wiring board layer (also referred to as PWB). The base layer 108 may be formed from a dielectric material. In some examples Kappa 438, available from Rogers Corporation in Chandler, Ariz., may be used as the base layer material, however other dielectric materials are contemplated. The base layer 108 may function as the mounting location for input microstrips 122 and the splitter 124. The input feed connectors 104 are each connected with microstrips 122, respectively, which both connect to splitter 124. Each of the microstrips 122 run along a centerline of the base layer 108 to the splitter 124 in the center of the base layer 108.

The antenna includes a splitter. In the present examples, the splitter 124 is a 90-degree hybrid splitter which sends power through the antenna stack 106. The 90-degree hybrid splitter 124 includes at least two outputs, a 0-degree output and a 90-degree output to provide two waves which are 90 degrees out of phase with each other. The splitter 124 is connected with output microstrips 120 and ran through slots in the substrate layer 110 to the composite layer 112, connecting to the radiating elements 116 (described further below). Each of the output microstrips 120 connected with a respective radiating element 116 for the right-hand circular polarization (RHCP) and left-hand circular polarization (LHCP).

Figure 5:
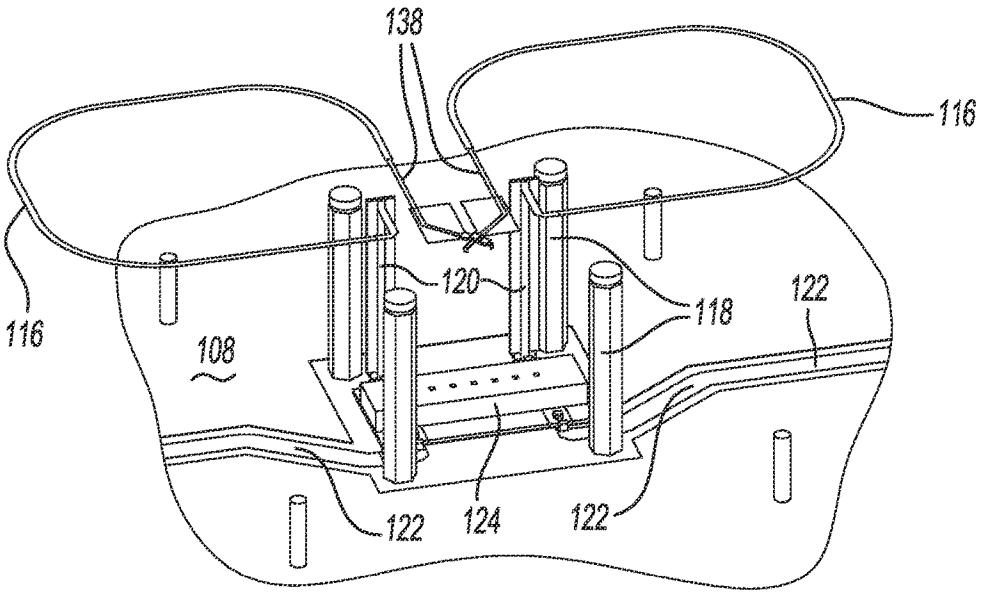
FIG. 5 is an enlarged view of the base layer of the antenna assembly showing a splitter and microstrips leading to a pair of radiating elements.

FIG. 5 shows the output microstrips 120 connecting to the radiating elements 116 in a magnified schematic view. The output microstrips 120 are transmission lines that carry the RF powers upward from the splitter 124 to the two radiating elements 116. The posts 118 are aluminum standoffs that support the composite layer 112 on which the radiating dipole elements 116 are connected as a metallization layer on the top metallization layer of the composite layer 112.

Figure 6:
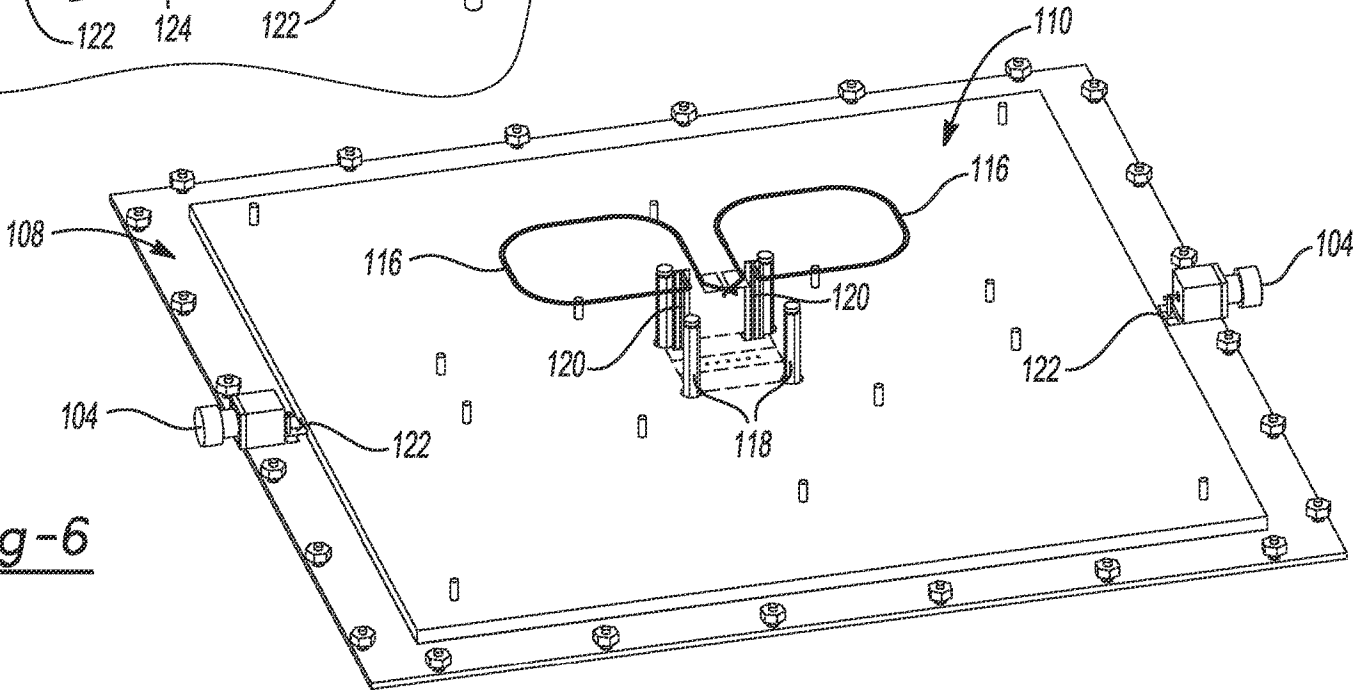
FIG. 6 is a schematic view of a substrate layer with the microstrips leading to a pair of radiating elements.

FIG. 6 illustrates the substrate layer 110. The substrate layer 110 may be made from one or more composite materials. In some examples, the one or more composite materials possess controlled permeability and permittivity that are intended for use in as radio frequency (RF) materials, primarily in antenna applications where the material allows for substrate impedance match to free space. The substrate layer 110 may be made from one or more materials which is made of high temperature thermoplastic composites, intended for use at frequencies up to five hundred mega-hertz (500 MHz). The substrate layer 110 material assists in antenna miniaturization below 500 MHz, where antennas are traditionally large due to their wavelength. The substrate layer 110 may exhibit stable electrical properties with frequency and modify effective permeability and permittivity to control effective substrate properties, change relative volume of dielectric and magneto-dielectric materials.

In the present example, the one or more substrate layers 110 may be comprised of an anisotropic magneto-dielectric material that has less loss and a wider bandwidth than a high dielectric material with performance over temperature. The substrate layer 110 is sized with a thickness to give λ/4 spacing at low end of frequency (e.g., between 100-500 MHz), maximizing thickness of material across the entire antenna, and gives the highest gain at the low end of the band. The anisotropic magneto-dielectric material assists in "shrinking" the sizes of physical dimensions of the antenna assembly 100, particularly the radiating elements, the bandgaps formed in the ground plane, and the physical length offset from the composite layer 112. In some examples, Magtrex 555, available from Rogers Corporation in Chandler, Ariz., may be used as the substrate layer 110. Put another way, in addition to contributing to shrinking the length and width of the antenna assembly 100, the anisotropic magneto-dielectric material allows the reduction of the distance D required between the composite layer 112 and the substrate layer 110, shortening the electrical height of the antenna assembly 100. In some examples, the distance D between the composite layer 112 and the substrate layer 110 corresponds with the nearfield of the target range the antenna assembly 100 is designed to operate within, such as between about $1/10^{th}$ to about $1/16^{th}$ of the size of the wavelength. In one example, at 300 Mhz, the wavelength is approximately 1 meter resulting in an example distance D between 5 centimeters and 10 centimeters. Other frequency wavelengths and distances D between the composite layer 112 and the substrate layer 110 are contemplated. The higher the electrical height, the lower the angle of radiation will be towards the horizon for a given antenna, as needed to provide an improved hemispheric antenna pattern, such as for communicating with satellites that appear to be close to the horizon. The contents of U.S. Pat. No. 9,596,755B2 are incorporated by reference.

Figure 7:
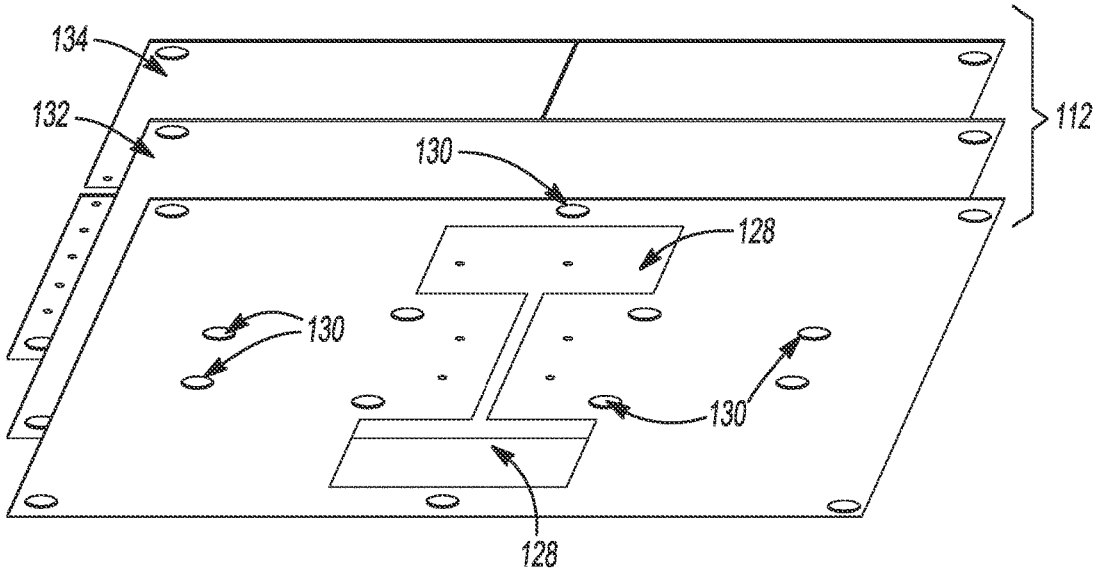
FIG. 7 is a bottom perspective exploded view of a composite layer.
Figure 8:
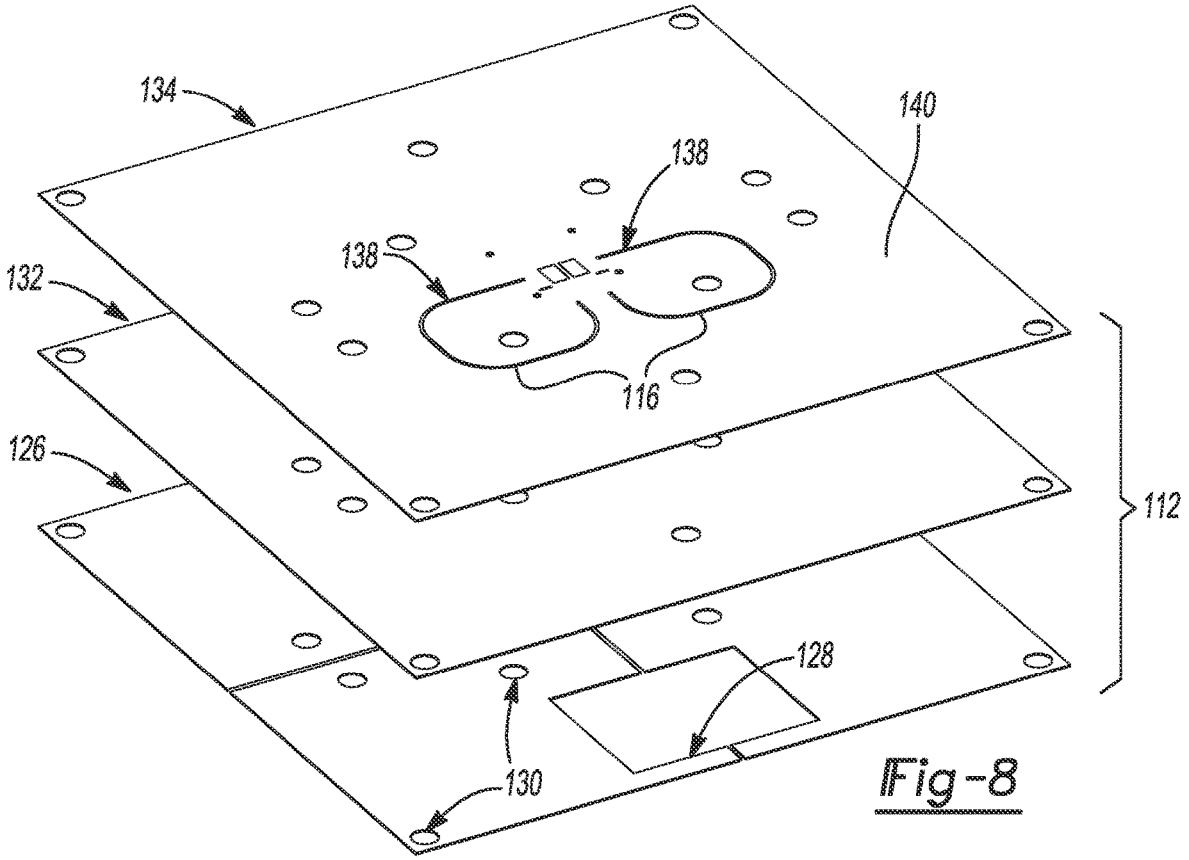
FIG. 8 is a top perspective exploded view of the composite layer.

The output microstrips 120 and posts 118 pass through one or more substrate layers 110 to the composite layer 112. As seen in FIGS. 7 and 8, the composite layer 112 is comprised of a top surface 134, an intermediate material 132, and a bottom surface 126. The composite layer 112 has a smaller dimension than the substrate layer 110. The composite layer 112 is secured to posts 118 with fasteners.

The bottom surface 126 of the composite layer 112 is a ground plane. In FIG. 7, the ground plane 126 of the composite layer 112 is shown schematically. As best seen in FIG. 7 and FIG. 8, the ground plane 126 defines a defected bandgap (DBG) 128 having a first end and a second end, the first end at least partially disposed under and overlapping the two radiating elements, and the second end positioned opposite the radiating elements. The ground plane 126 contains an aperture shaped as a modified H-shaped and/or "dumbbell" shaped DBG structure 128. However, other shapes and sizes of the DBG 128 are contemplated. The DBG 128 is a portion of the ground plane formed as a patterned void that transforms the ground plane 126 into a high impedance structure (H.I.S.) at a select frequency range. The DBG 128 may eliminate the presence of any circulating ground currents that would otherwise flow in this ground plane layer 126 when in the presence of radiated fields generated by the radiating elements 116 located above this ground, separated by the presence of the intermediate material 132 (i.e., a dielectric layer that is sandwiched between the ground plane 126 structure and the top plane 134 which is a radiating element 116 upper metallization layer). In some examples, the DBG 128 as shown throughout FIGS. 7 and 8 may prevent circulating ground currents between 220 MHz and 300 MHz.

To determine the appropriate size and shape of the defected bandgap (DBG) 128 for the target operating frequency range of the antenna assembly 100, the size of the antenna must be determined and subsequently scaled down, as described above. To scale the antenna, the antenna element is sized based on the free space wavelength apart from an anisotropic magneto-dielectric material. The antenna element is then scaled down based on the square root of dielectric constant of the permittivity constant ($E_r$) multiplied by the square root of permeability constant ($M_r$) of the selected anisotropic magneto-dielectric material. Once the antenna element is sized based on the substrate layer material (e.g., Magtrex 555), the size of the DBG 128 is calculated.

The DBG 128 is designed relative to the function of frequency with a 50-ohm transmission line at the frequency of interest. The transmission line is on the top surface, being fed with power, and DBG 128 on the bottom surface. In some examples, the size of the ground plane beneath the microstrip line is adjusted until the loss of the microstrip increases by about 1 dB to about 10 dB. In some examples, the size of the ground plane beneath the microstrip line is adjusted until the loss of the microstrip increases by about 1 dB to about 2 dB. The dimensions of the DBG are designed to accommodate the target frequency. In some examples, the resonance frequency is 1.1 to 1.4 over the target operating frequency. The band edge of the loss is adjusted downward by increasing the size of the DBG 128, reducing the cut-off frequency of the ground plane by a factor of about 20 percent to about 50 percent relative to the lowest frequency and highest frequency, respectively, until the loss is reduced to about 0.1 dB to about 0.5 dB within the desired passband. In some examples, the defected bandgap 128 reduces fall off of the frequency by 20 percent to 50 percent in a particular range. The dimensions of the DBG 128 are adjusted as not to impact the insertion loss of the microstrip line at the desired frequency range. In some examples, the DBG 128 is scaled about 1.2 to about 1.5 times over the target frequency range and then adjusted to be resonant above about 20 percent to about 50 percent above the target frequencies/bandwidth of the target operation of the antenna. In other words, the size of the DBG 128 is scaled larger by a factor of about 1.2 to about 1.5, reducing the frequencies over which the ground plane 126 is converted from a conductor into a semi-conductor.

The ground plane 126 further includes circular holes in the ground plane 126, which introduces a plurality of photonic bandgap (PBG) structures 130, a more general form of a DBG, which provides the advantage of a DBG at higher frequencies than the dumbbell DBG 128 provides in this example. A PBG 130 is a portion of the ground plane formed as a plurality of patterned voids that transforms the ground plane 126 into a high impedance structure (H.I.S.) at a select frequency range. In some examples, such as shown in FIGS. 7 and 8, the PBG 130 may prevent circulating ground currents between 300 MHz and 380 MHz. Together, the DBG 128 and the PBG 130 circular cutout structures in the same physical ground plane 126 provide the benefits of a defected bandgap operating over the lower frequencies as provided by the DBG shape 128 and over the higher frequencies as provided by the PBG circular shape 130 defects placed into the ground plane 126.

Similar to the DBG 128, the PBG 130 is designed relative to the function of frequency. The PBG 130 is adjusted based on the frequency range of interest. The PBG 130 is placed in the ground plane 126 with a series of small circular holes forming the photonic bandgap ground 130. In some examples, the circular holes forming the PBG 130 are increased in size such that the microstrip loss is increased by about 1 dB to about 10 db. In some other examples, the circular holes forming the PBG 130 are increased in size such that the microstrip loss is increased by. about 1 dB to about 2 dB within the desired passband. The size of PBG 130 is reduced by a factor of about 1.2 to about 1.5, which increases the frequencies over which the PBG 130 electrically decouples the ground plane, reducing the loss through the microstrip line to about 0.1 dB to about 0.5 dB.

By scaling the DBG 128 and PBG 130, the semiconductor region over the entire desired operating frequency region is increased for which the miniaturized antenna is to be operated. By scaling the entire DBG 128 by an increase of about 1.2 to about 1.5 the higher the impedance the ground plane frequencies below the desired operating passband relating to the DBG 128 shape. By scaling the PBGs by a reduction of about 1.2 to about 1.5, the higher impedance the ground plane frequencies above the desired operating passband relating to the PBG 130 shape. In some examples, the PBGs 130 reduce fall off of the frequency by 20 percent to 50 percent in a particular range. The portions of the ground plane 126 that are not removed to form the DBG 128 and PBG 130 is a semiconductor region over the entire desired operating frequency region for which the miniaturized antenna is to be operated.

The location of the DBG dumbbell shape 128 provides a high impedance structure (H.I.S) in just the DBG ground, which is what isolates and prevents coupling through the bottom ground plane 126 from occurring between the two ends of the radiating elements 116. As seen in FIGS. 7 and 8, the DBG 128 includes a first end and a second end, the first end at least partially disposed under and overlapping the radiating elements and the second end is positioned opposite the radiating elements. By removing this coupling between the two ends of the dipole radiating elements 116 in the ground plane 126 beneath them, this in turn enables increasing the bandwidth of the antenna assembly 100 as a whole. In some examples, when the radiating elements are electrically coupled through 3-D space as well as through the 2-D ground plane beneath them in a traditional, larger implementation of an antenna, the increased coupling between the two radiating elements of the dipole results in decreasing the operating bandwidth of the radiating elements as the antenna size is shrunk. By reducing the coupling through the ground plane 126 by the insertion of the DBG 128 and PBG 130 ground plane structures, this introduces a H.I.S., and the normally conductive ground plane becomes analogous to an artificial dielectric or a metallic semiconductor, as a function of operating frequency. In the present example, a normally conductive ground plane is converted into a semiconductor that, despite being made of metal, becomes a very poor conductor only over the frequencies of interest (e.g., 100 MHz-500 MHz). Outside the frequencies of interest, the metal reverts to being a normal conductive layer. This DBG structure 128 creates a unique frequency selective surface (F.S.S.) that remains a good conductor outside the frequencies over which the DBG 128 and PBG 130 shapes are designed to control the conductivity of the bottom ground plane layer 126, while making the metallic portion a semiconductor over the desired frequencies of interest. Although the present disclosure provides for an operational frequency range of 100-500 MHz, other frequency ranges are contemplated.

The DBG 128 and PBG 130 shapes also improve the efficiency of the antenna assembly 100 as a whole by reducing the magnitudes of circulating ground currents beneath the radiating elements 116 that cause small antennas to be inefficient, by causing conversion of the power of the circulating currents into heat, rather than increasing the amount of energy that is radiated by the radiating elements 116.

As seen in FIGS. 7-8, the intermediate material 132 is shown in the composite layer 112. The intermediate material 132 may be a dielectric material that is sandwiched between the top plane 134 and the bottom ground plane 126 in the composite layer 112. In some examples, Rogers RO4534 dielectric material, available from Rogers Corporation of Chandler, Ariz., may be used as the dielectric intermediate material in the composite layer 112.

The presence of the anisotropic magneto-dielectric material, coupled with the DBG 128/PBG 130 structure, combines to cause a reduction in the size of the radiating elements 116 to achieve a given performance in terms of implementation into a smaller physical volume, and a smaller physical area, simultaneously providing useful operation over a wider bandwidth, all simultaneously, which allows achieving an improvement in the radiation efficiency of a small antenna. The result is a miniaturized antenna that performs much like a traditional antenna occupying a much larger size and volume. For example, a traditional antenna assembly which operates between 200 MHz and 400 MHz may have a size of 18 inches long by 18 inches wide by 14-18 inches height may be reduced to approximately 18 inches long by 18 inches wide by 2 inches height while maintaining the same efficiency and range. The ability to achieve the higher performance of a larger antenna in a greatly reduced volumetric size is advantageous.

The top plane 134 of the composite layer 112, as seen in FIGS. 7 and 8, includes the one or more radiating elements 116. The radiating elements 116 function to covert energy into a resonate frequency. In the examples shown in FIGS. 7 and 8, the radiating elements 116 are configured as dipoles. The one or more radiating elements 116 are connected to the output microstrips 120 by planar transmission lines 138, connecting the one or more radiating elements 116 with the 0/90 hybrid splitter 124 on the base layer 108. The radiating elements 116 may be arranged to work in conjunction with the 0/90 hybrid splitter 124 to produce a right hand circularly-polarized (RHCP) configuration. The output microstrips 120 are fed with a 90-degree phase shift form the hybrid splitter 124 to convert from radiating linear polarization to RHCP polarization.

Figure 10:
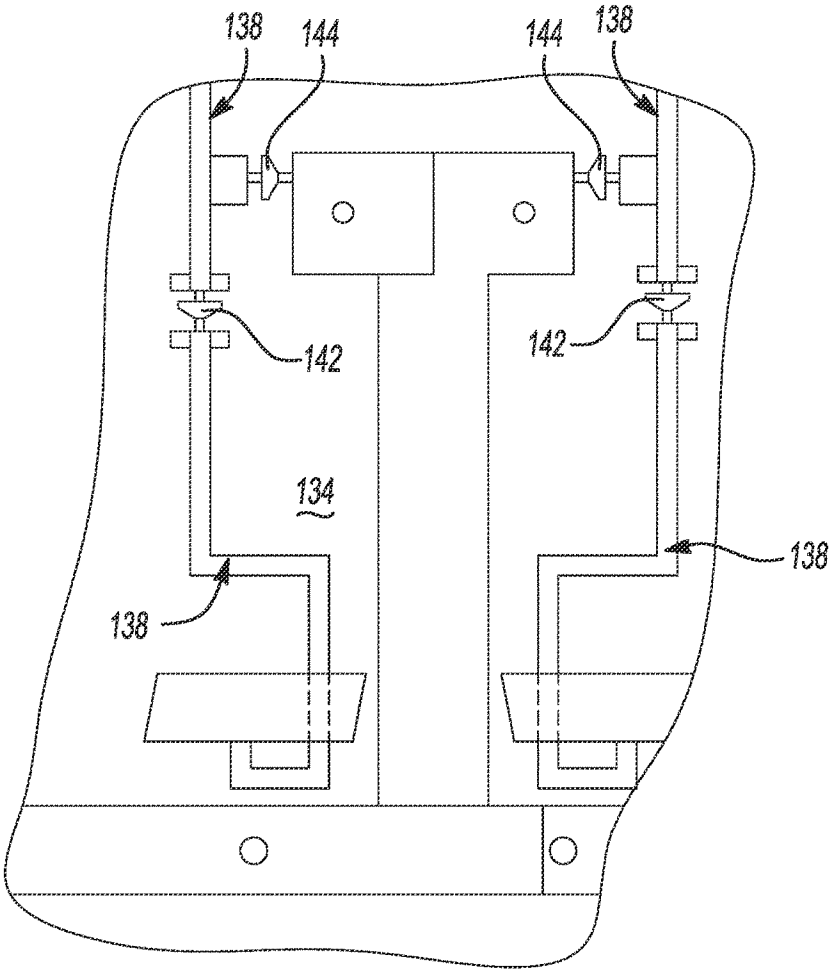
FIG. 10 illustrates an enhanced view of a portion of the strip line including capacitors and inductors.
Figure 9:
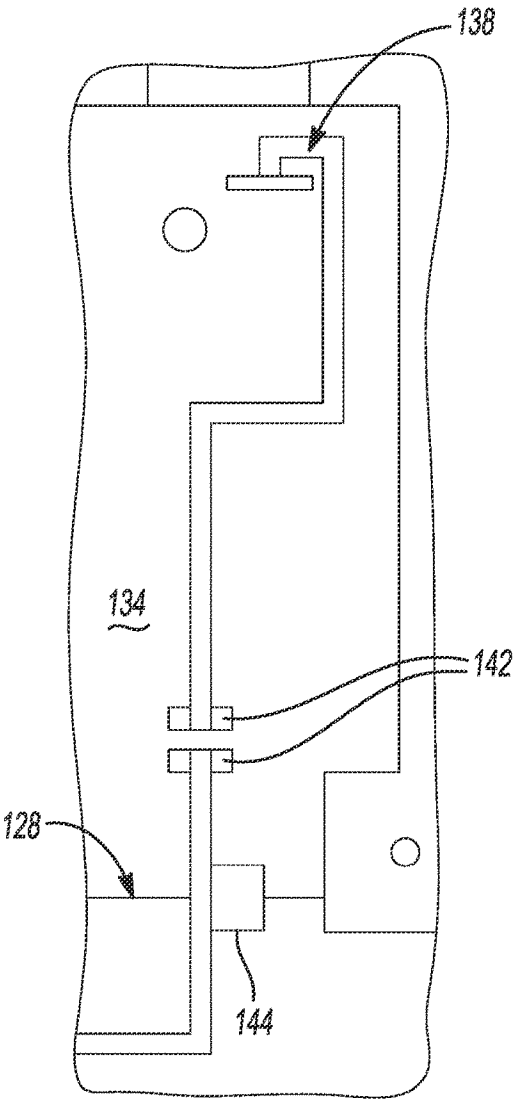
FIG. 9 is an enhanced view of a portion of the strip line including capacitors and inductors.

Further, as seen in FIGS. 9-10, the addition of the capacitors 144 and inductors 142 on each planar transmission line 138 provide for impedance transformation. Particularly, each radiating element 116 includes two capacitors 144 and two inductors 142 on each of the planar transmission lines 138 connecting to the radiating elements 116, forming a 4:1 impedance transformer. In some examples, if only one radiating element 116 is present, a coupler, instead of an impedance transformer, would be implemented.

Traditional techniques incur the Bode-Fano limit that restrict the maximum bandwidth over which matching from one impedance to another impedance is possible when the ratio of impedances becomes large. In the present teachings, this Bode-Fano limit still applies, but is greatly lessened, compared with conventional lumped element capacitors impedance transformation arrayed in a variety of configurations of L-C, C-L, C-L-C, and L-C-L impedance circuits.

Both high-pass and low-pass filter structures can be used to effect an impedance transformation. Similarly, Pi-Network (with components arrayed like the Greek Letter "Pi") and L-Network (with the components arrayed in a L-shape) may be used to implement impedance matching functionality. This technique competes well with the higher impedance transformation ratios achievable with the Pi-Network, in terms of impedance ratios over which becomes possible to match, while improving the bandwidth over which the same desired impedance transformation is achieved.

By incorporating the select capacitors 144 and inductors 142 disposed on the planar transmission line (also known as a feedline) 138, and the DBG 128 and PBG 130 in the ground plane 126, a miniaturized broadband transformer for effecting the transformation of high impedances of a miniaturized antenna into a much lower impedances, versus frequency, becomes significantly easier to couple RF power.

Figure 11:
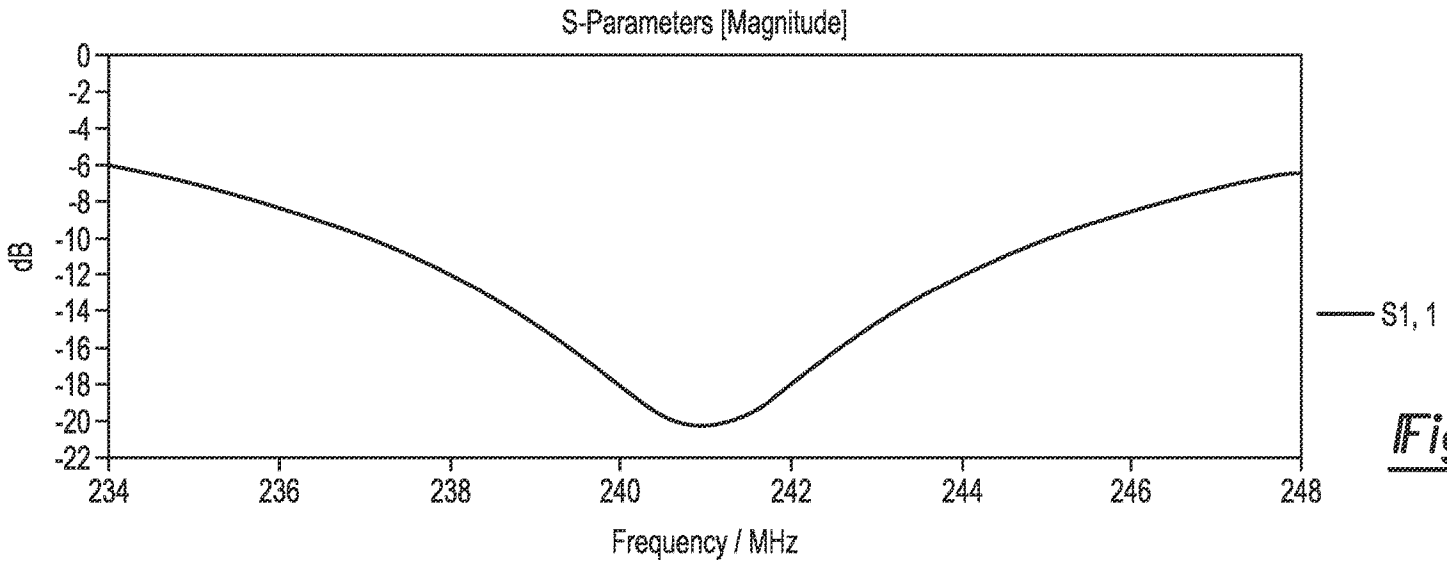
FIG. 11 is a graph showing return loss of an antenna without a defected bandgap consistent with the teachings herewith.
Figure 12:
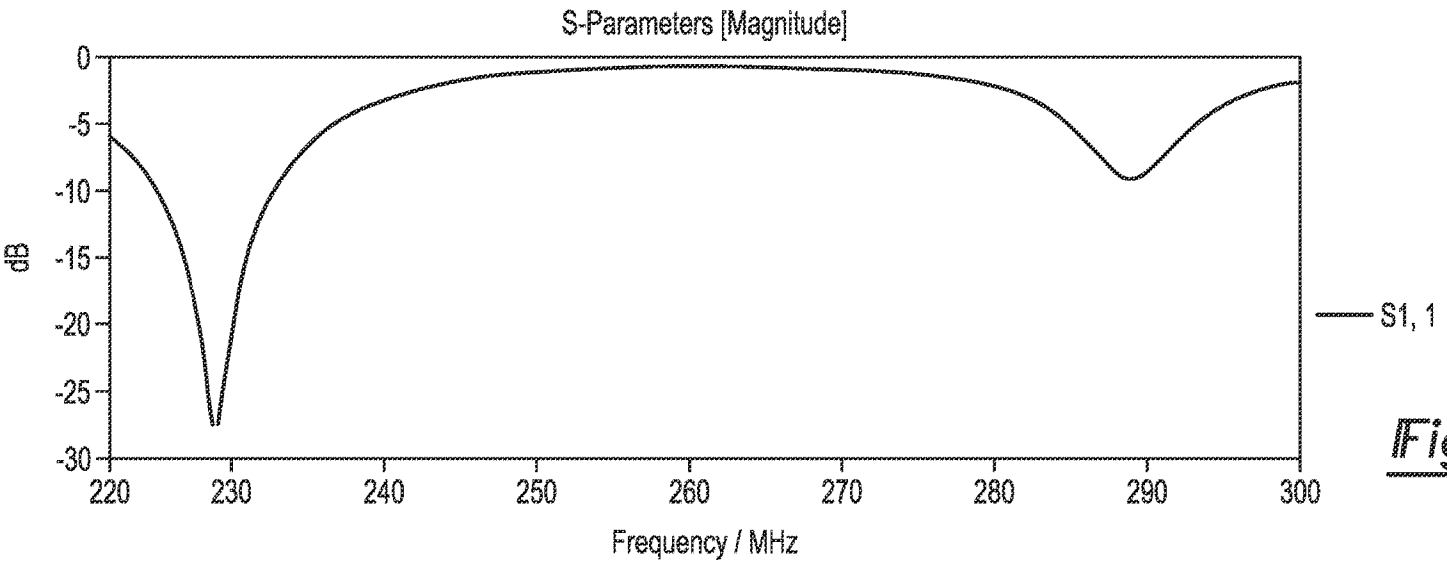
FIG. 12 is a graph showing return loss of an antenna with a defected bandgap.

Turning to FIGS. 11 and 12 show the difference return loss of similar miniaturized planar antennas. FIG. 11 depicts the return loss of a miniaturized planar antenna with a magneto-dielectric material utilizing a composite layer ground plane with a plurality of PBGs. FIG. 12 depicts the frequency range of a miniaturized patch antenna with a magneto-dielectric material utilizing a composite layer ground plane with a DBG and a plurality of PBGs. Both the antennas in FIGS. 11 and 12 are approximately the same size, with the same power inputs, and the same magneto-dielectric material (Magtrex 555). FIG. 11 shows a Voltage Standing Wave Ratio (VSWR) of an antenna without the Defected Bandgap arrangement, displaying a 3:1 VSWR bandwidth (i.e., 6.02 dB return loss) of approximately 14 MHz and a 2:1 VSWR (9.54 dB return loss) of about 7.5 MHz.

In contrast, FIG. 12 shows the antenna structure including the Defected Bandgap (DBG) high-impedance structure in the same design as the antenna of FIG. 11. When the DBG is included in the ground plane of the antenna, the antenna shows a 3:1 VSWR (6.02 dB return loss) operating bandwidth of about 19 MHz, and a 2:1 VSWR (9.54 dB return loss) operating bandwidth of about 13 MHz. The 2:1 VSWR bandwidth is nearly doubled (13/7.5=1.73) of the antenna without the DBG structure, showing an improvement of about 73% in operating bandwidth. The 3:1 VSWR bandwidth of the antenna of FIG. 12 is similarly improved (19/14=1.375, showing an improvement of about 37.5%). The DBG structure improves the match in terms of amplitude value of return loss, as well as broadens the usable operating bandwidth of the antenna. The 3:1 VSWR provides a mismatch loss of only 0.51 dB, in terms of lost transmitting power occurring due to mismatches that exist between a source transmitter and a load antenna, which is a negligible reduction in transmitter power. The 3:1 VSWR works well for setting the maximum usable bandwidth for most antennas. In one example of the SATCOM planar antenna design, with the 90 degree hybrid providing 0 degrees and 90 degrees outputs to generate circular polarization by feeding two antenna elements 90 degrees out of phase, and by virtue of the 90-degree hybrid routing reflections from any mismatches occurring with the antenna elements to a 50 Ohm termination (instead of back out the connectorized input), thereby improving the return loss at the RHCP or LHCP connectorized inputs, we mask even this slight mismatch. The DBG structure increases the usable operating bandwidth of a planar antenna significantly and improves the efficiency of a UHF planar SATCOM antenna, by widening the operating bandwidth significantly vs. the case of not using a DBG ground plane structure.

Further, as can be seen in FIG. 12, the match is noticeably better at resonance, exceeding 27 dB return loss, versus FIG. 11 which only slightly exceeded 20 dB return loss. The elimination of circulating currents in the high-impedance ground plane structure improves the efficiency of the antenna with the DBG ground plane structure. The DBG ground plane structure increases the effective isotropic radiated power being radiated from any planar antenna by matching amplitude of return loss and increasing operating bandwidth at resonance.

Several examples have been discussed in the foregoing description. However, the examples discussed herein are not intended to be exhaustive or limit the teachings to any particular form. The terminology that has been used is intended to be in the nature of words of description rather than of limitation. Many modifications and variations are possible in light of the above teachings and may be practiced otherwise than as specifically described.

What is claimed is:

1. An antenna assembly comprising:

a base;

one or more substrate layers disposed above the base, at least one of the one or more substrate layers having an anisotropic magneto-dielectric material; and a composite layer disposed above the one or more substrate layers, the composite layer including:

one or more radiating elements on a top surface;

a ground plane forming a bottom surface and defining a plurality of bandgaps;

a dielectric material between the one or more radiating elements and the ground plane, the dielectric material being different from the anisotropic magneto-dielectric material;

wherein the plurality of bandgaps defined by the ground plane include a first bandgap and a plurality of second bandgaps, wherein the first bandgap reduces circulating ground currents at a first frequency range, and the plurality of second bandgaps reduces circulating ground currents at a second frequency range.

2. The antenna assembly of claim 1, wherein the first bandgap and the plurality of second bandgaps make the ground plane a high impedance structure throughout an operational frequency band, causing the ground plane to be a frequency selective surface, reducing loss of radiation by decreasing circulating ground currents at the first frequency range and the second frequency range.

3. The antenna assembly of claim 2, wherein the antenna assembly has an operational frequency of 200-400 MHz.

4. The antenna assembly of claim 2, wherein the first bandgap is a defected bandgap that reduces fall off of the first frequency range by 20 percent to 50 percent.

5. The antenna assembly of claim 4, wherein the defected bandgap prevents circulating ground currents between 200 MHz and 300 MHz.

6. The antenna assembly of claim 2, wherein the plurality of second bandgaps are photonic bandgaps configured to reduces fall off of the second frequency range by 20 percent to 50 percent.

7. The antenna assembly of claim 6, wherein the photonic bandgap prevents circulating ground currents between 300 MHz and 400 MHz.

8. The antenna assembly of claim 1, wherein the first bandgap includes a first end and a second end, the first end at least partially disposed under the one or more radiating elements, and the second end positioned opposite the one or more radiating elements.

9. The antenna assembly of claim 2, wherein the ground plane is a semiconductor over the operating frequency.

10. The antenna assembly of claim 1, wherein the first frequency range overlaps with the second frequency range.

11. The antenna assembly of claim 1, wherein the first frequency range is different than the second frequency range.

12. The antenna assembly of claim 1, wherein the substrate layer is spaced apart from the ground plane by a distance.

13. The antenna assembly of claim 2, wherein the one or more radiating elements are two radiating elements, and the first bandgap and the plurality of second bandgaps are configured to electromagnetically decouple the radiating elements with respect to each other throughout the operational frequency.

14. The antenna assembly of claim 1, wherein the at least one radiating element is two radiating elements, and wherein the ground plane defines a defected bandgap having a first end and a second end, the first end at least partially disposed under and overlapping the two radiating elements, and the second end positioned opposite the radiating elements.

15. The antenna assembly of claim 14, wherein the plurality of second band gaps are a plurality of photonic bandgaps having a circular shape.

16. The antenna assembly of claim 15, wherein the defected bandgap and photonic bandgaps decrease magnitudes of circulating ground currents beneath the two radiating elements throughout an operational frequency of 100 to 500 Mhz, increasing energy radiated by the two radiating elements throughout the operational frequency.

17. The antenna assembly of claim 16, wherein the defected bandgap prevents circulating ground currents at the first frequency range, and the plurality of photonic bandgaps prevents circulating ground currents at the second frequency range.

18. The antenna assembly of claim 14, wherein the anisotropic magneto-dielectric material and the plurality of bandgaps electromagnetically decouple the two radiating elements with respect to each other.

* * * * *